US008253562B2

(12) United States Patent
Jay

(10) Patent No.: US 8,253,562 B2
(45) Date of Patent: Aug. 28, 2012

(54) ELECTRONIC FUEL TANK, AND NOTIFYING SYSTEM FOR ENGINE POWERED MODEL CRAFT

(75) Inventor: Luis Adolfo Jay, Atlanta, GA (US)

(73) Assignee: Luis Adolfo Jay, Atlanta, GA (US)

( * ) Notice: Subject to any disclaimer, the term of this patent is extended or adjusted under 35 U.S.C. 154(b) by 268 days.

(21) Appl. No.: 12/798,011

(22) Filed: Mar. 29, 2010

(65) Prior Publication Data

US 2010/0294777 A1 Nov. 25, 2010

Related U.S. Application Data

(60) Provisional application No. 61/216,543, filed on May 19, 2009.

(51) Int. Cl.
*G08B 21/00* (2006.01)

(52) U.S. Cl. ..... 340/540; 340/945

(58) Field of Classification Search ..... 340/540
See application file for complete search history.

(56) References Cited

U.S. PATENT DOCUMENTS

| | | | | |
|---|---|---|---|---|
| 6,571,626 | B1 * | 6/2003 | Herford | 73/314 |
| 7,000,654 | B1 * | 2/2006 | Rossi | 141/95 |
| 2008/0218363 | A1 * | 9/2008 | Howayshell | 340/612 |

* cited by examiner

*Primary Examiner* — George Bugg
*Assistant Examiner* — Kerri McNally

(57) ABSTRACT

My invention's new fuel tank with built in sensor, and analytical software is new to the present world of Radio Control Modeling. So is the 5-wire independently programmable annunciating, light emitting diode arrays. This invention will allow modelers in the Academy of Model Aviation (AMA) to enjoy the sport in a more relaxed, safe, and enjoyable manner by not having to worry about running out of fuel up in the air, or model boaters running out of fuel in the middle of a lake, or model car racers running out of fuel far from the pit stop. This invention is novel to the above-mentioned sport/s.

7 Claims, 3 Drawing Sheets

ELECTRONIC FUEL TANK, AND NOTIFYING SYSTEM FOR ENGINE POWERED MODEL CRAFT

CROSS REFERENCE

Electronic Fuel tank, and Notifying System for Engine Powered Model craft. Provisional patent application filed May 5, 2009. Application No. 61/216,543

BACKGROUND

To the present day the sport of model aviation with over 150,000 AMA (Academy of Model Aeronautics) members and over 2,500-chartered clubs has no means to gauge the amount of fuel in the aircrafts fuel tank. The methods presently used are to time the running engine with a clock, making it imprecise, risky and dangerous. Running out of fuel in mid air causes an "emergency situation" for the plane, the people on the ground, and personal property. I invented, made, tested and use the invention out of the necessity to have a means of knowing when I was running out of fuel depending on actual engine rpm usage, not a timed clock estimated guess with many times running out of gas in mid air so as to make a safe, and pleasant landing, thus protecting my model, people and property.

The invention greatly improves on the present methods making the sport more enjoyable, safer, and stress free. The invention can also be used on engine-powered model boats to prevent running out of fuel in the middle of a lake, and for model racing cars to know when you need to safely make a pit stop. The invention is for use only in non-passenger carrying engine powered model craft.

BRIEF SUMMARY

The apparatus is an electronic fuel level sensor, and notification system, specifically for use with model airplanes, model cars, and other radio controlled, and scale engine powered vehicles that operate with liquid fuel. The apparatus comprises a float-actuated switch, a signal processing unit, and a notifying or annunciating device. The float actuated switch position is monitored by the signal-processing unit, which controls a notifying device such as a LED (light emitting diode) light display, visually representing the liquid fuel level.

DETAILED DESCRIPTION OF INVENTION

As shown on FIG. 1 the tank is filled with fuel through tube 2, the fuel travels down hose 3. and out weighted fuel nozzle 4. As the tank fills the magnetized float 6 floats upwards opening the reed switch in the float switch shaft 10. Float stop 5 prevents the float from detachment.

When there is fuel in the tank the float switch is held open keeping the computers processing and light annunciating display off. The light annunciating display has four rows that are independently programmable LED (light emitting diode), and four resistors to limit LED current. The minimum number of LED is four or one per row (array) the prototype uses 12 LED.

The computer board gets it's input via J1 FIG. 2 from the float switch sensor, the software analyses the input signals, makes a decision and sends the proper LED blinking pattern to the display. There are three distinct lighting patterns to alert the modeler.

Refer to Appendix A: The software consists mainly of three modes. Mode 0, and Mode I initially work together, they are silent, sending no warning but analyzing fuel conditions in the tank only. Later in the process Mode I will work mainly with Mode II to monitor and compensate for the crafts movements. The program can call on Mode 0 only in the rare even that Mode I & Mode II should request it due to unusual conditions like flying upside down for extended periods is one example. Mode 0 re-starts analysis, silently and repetitiously monitors the fuel conditions.

Mode II warnings informs that the tank is running low, burns an increment of fuel, and tests for fuel condition again, and using Mode I it will turn all the lights off for 7 seconds. If it finds fuel in the tank; For instance the model could have been flying upside down a long time on half empty but there is still plenty of fuel in the tank, it will then re-start the analysis through Mode I. If it does not find fuel it will send another warning and re check. It will test for fuel 30 times in 15 seconds or send it to Mode 0 if it so deems before it "locks in" sending the final continuous landing time light patterns. There are three distinct lighting patterns.

If the computer has determined that there is a "true" low fuel condition it will flash non-stop with no off intervals, it will not re-check for fuel, and it cannot be exited: it has "locked in" with about 4 minutes left of fuel to safely land. The modeler can adjust the landing time by manually setting the float height.

Although the present invention has been described with reference to preferred embodiments, workers skilled in the art will recognize that changes may be made in form and detail without departing from the spirit and scope of the invention.

1. Tank pressurizing tube from engine.

2. Fuel line tube to engine.

3. Rubber fuel line.

4. Weighted fuel nozzle.

5. Float stop.

6. Float. Adjustable to select the desired time for low fuel warning.

7. Top retaining nut.

8. Bottom retaining nut.

9. Signal wire.

9*a*. Signal wire to ground.

10. Float switch shaft.

11. Cap retaining nut.

12. Cap screw.

Figure 1:
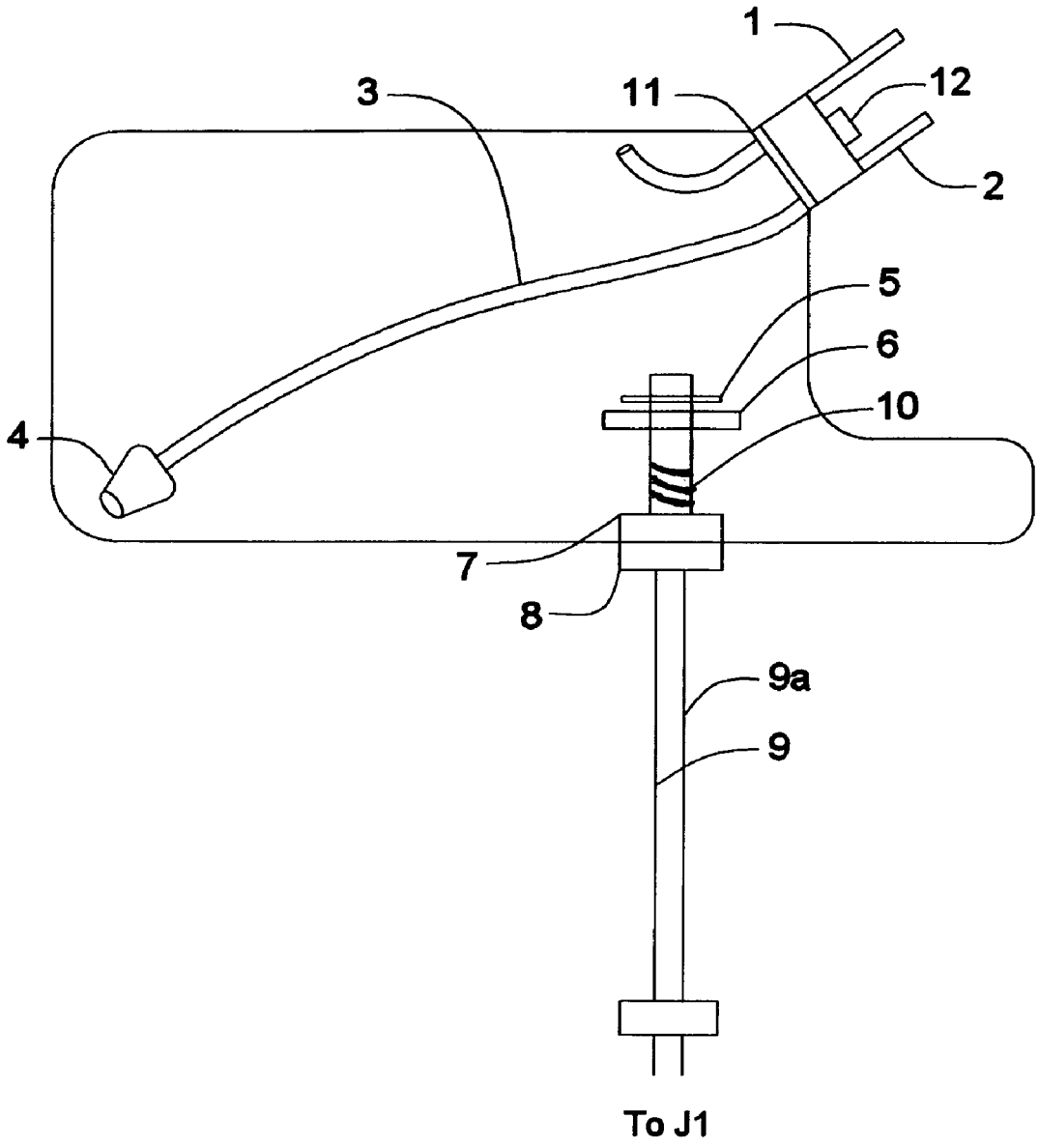
FIG. 1: New improved fuel tank.
Figure 2:
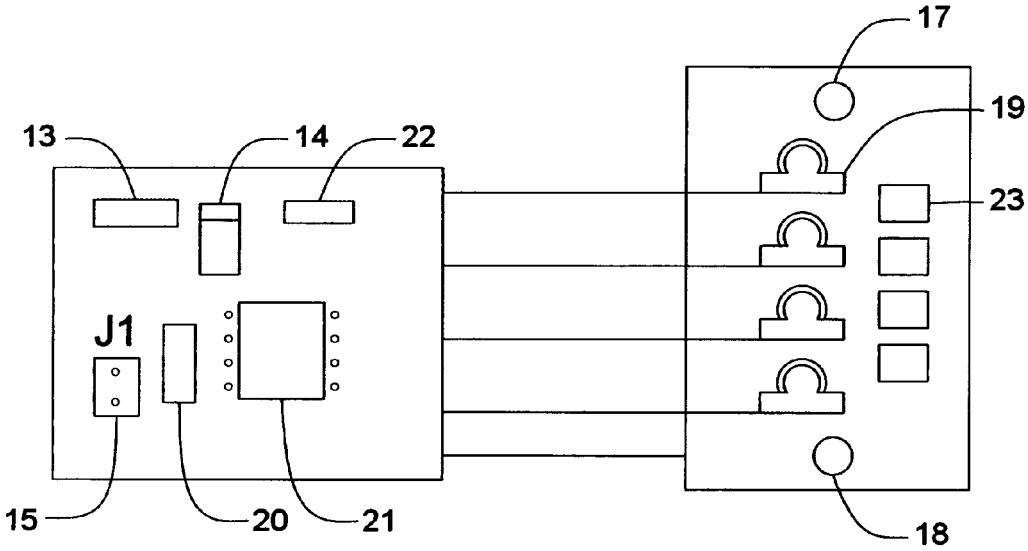

FIG. 2: Notification System.

13. Resistor R1.

14. Zener diode D1.

15. Connector to connect tank into.

16. Connecting wires.

17. Mounting hole.

18. Mounting hole.

19*a*-19*d* LED: four minimum.

20. Resistor R3.

21. PIC 12F683, 8-pin Micro-controller chip.

22. Resistor R2.

23*a*-23*d*. LED resistors.

Figure 3:
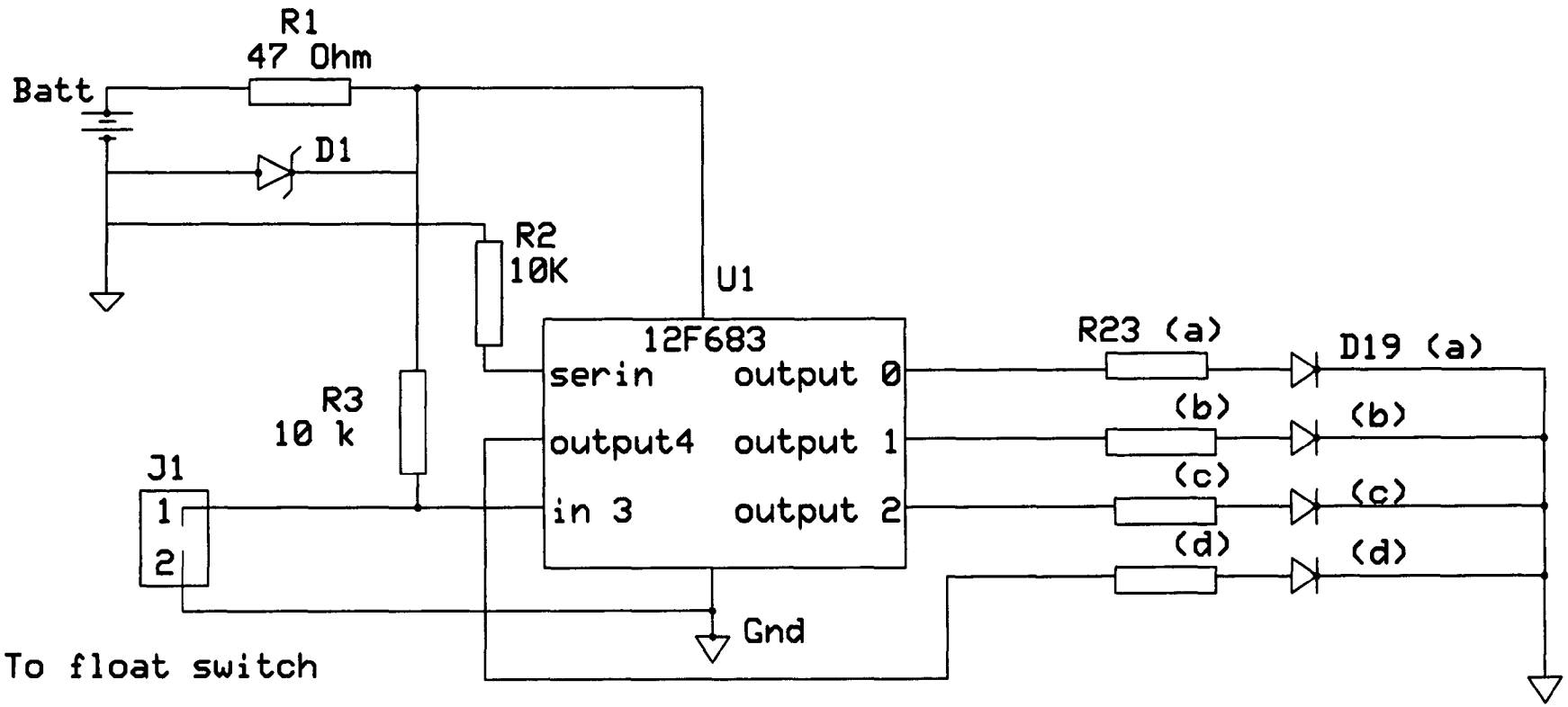

FIG. 3: Circuit Board Schematic.

APPENDIX A

```
' Computer Program for Electronic Model Fuel tank, and Notifying
'System for Engine Powered Model craft.
Mode0:                  ' Mode0 and Mode1 work together to test for
                        ' low fuel, but there are conditions, like
                        ' flying up-side down, climbing, choppy water
                        ' or a lot of hills. The program re-checks it
                        ' self continuously to insure proper warning:
                        ' regardless of conditions__
    symbol counter = b1
    symbol
    counter2 = b2
    symbol c1 = b3
    symbol c2 =b4
    symbol
    landingcounter = b5
    counter = 0
    counter2= 0
    c1= 0
    c2 = 0
    landingcounter = 0
    dirs = 10111                ' Set pin 3 for input the rest for output
    low 0
    low 1
    low 2
    low 4
    if pin3 = 0 then goto New   ' Test sensor for out of fuel condition
    goto Mode0                  ' Loop it if sensor sees fuel
New:    pause 15000             ' Waite 15 seconds and test
                                sensor again.
    if pin3=0 then goto Mode1   ' If no fuel begin warnings after
    goto Mode0                  Mode 1 .
Mode1:                          'Mode 1
    c1 = 0
    c2 = 0
    counter=0
    counter2=0
    landingcounter =
    landingcounter + 1
    if landingcounter > 3 then  " Causes lock in condition it can
    goto Mode2                  " also be extended for more stringent
                                " testing.
    for counter=1 to 20
    if counter >15 then
    goto Mode2
    if pin3=1 then          " Mode I can return control to MODE 0
    goto Mode0              " at this point. Caused by unusual
                            " operating conditions
    pause 500
    next counter
Mode2:              ' Mode II, cannot be exited like MODE I.
                    " It does not test for fuel; that was done by Mode 0,
                    " and Mode I. It will check fuel again at the end of
                    " the 3 Pattern warning light sequence.
    let c1 = c1 + 1
    let pins = 00011    ' LED alternate rows, flashing: two on & two off
                        ' Very fast
    pause 50
    let pins = 10100
    pause 50
    if c1 = 15 then
    goto seriesled
    goto Mode2
seriesled:
    for counter2=
    1 to 25
    let pins = 10111        ' All LED flash all on/off at a medium rate.
    pause 110
    let pins = 00000
    pause 110
    next counter2
ledchaser:
    c2 = c2 + 1
    high 0              ' LED lights chase each other one ON a time.
    pause 70
    low 0
    pause 70
```

APPENDIX A-continued

```
    high 1
    pause 70
    low 1
    high 2
    pause 70
    low 2
    pause 70
    high 4
    pause 70
    low 4
    pause 70
    if c2 = 10 then goto        ' Go back and re-check fuel level all lights
    Mode1                       ' turn off for 7.5 seconds. Mode I can send
                                ' the program to Mode 0 again and re-start
                                "analysis this could be caused by
                                " extraordinary conditions like prolonged
                                " aerobatics etc..
                                "Mode 1 at this point will check for gas 15
                                'in 7.5 sec. and will do it twice or 30 times
                                'with all lights warning and a 7.5 second
                                "all lights off interval while it checks.
    goto ledchaser
                                ' After MODE I has done it's tests and
                                "decides it is time to land all light patterns
                                ' will lock in, it cannot be exited, it does
                                ' no further testing for fuel__
                                ' There is about 4 minutes to land before
                                ' engine cuts out__
                                ' You need to make a landing now! Bring
                                ' in your plane, car or boat.
    end
```

The invention claimed is:

1. A computerized electronic fuel tank system to be a part of engine powered model crafts to notify the modeler/operator of the time to bring in the model, and consisting of: a model craft fuel tank, a float switch sensor, a computer board, a software program, and an annunciating device.

2. The computerized electronic fuel tank system as claimed in claim 1, wherein the float switch sensor is built into the model craft fuel tank.

3. The computerized electronic fuel tank system as claimed in claim 2, wherein the computer board and the software program are used to indicate low fuel.

4. The computerized electronic fuel tank system as claimed in claim 3, wherein the annunciating device is at least one of a LED array, a sound transmitter, or a radio transmitter.

5. The computerized electronic fuel tank system as claimed in claim 4, wherein the annunciating device is a 5 wire light display consisting of four distinct and independently programmable LED (light emitting diode) arrays with at least one LED per array specifically to indicate a low fuel condition of a model.

6. A method of installing a system into a model craft fuel tank comprising: installing a float sensor, a computer board, a software program, and an annunciating device into a model craft fuel tank in order to monitor fuel level and indicate a low fuel condition.

7. A model craft installation kit comprising: a float sensor, a computer board, a software program, and an annunciating device; wherein when the float sensor, the computer board, the software program, and the annunciating device are installed into a model craft fuel tank system, the float sensor, the computer board, the software program, and the annunciating device work together to monitor fuel level of the model craft and indicate when a low fuel condition is present.

* * * * *